US006481488B1

(12) United States Patent
Johansen

(10) Patent No.: US 6,481,488 B1
(45) Date of Patent: Nov. 19, 2002

(54) APPARATUS FOR PRODUCING CASTING MOULD PARTS AND COMPRISING AUXILIARY GUIDING MEANS

(75) Inventor: Jan Bechmann Johansen, Humlebæk (DK)

(73) Assignee: Disa Industries A/S, Herlev (DK)

( * ) Notice: Subject to any disclaimer, the term of this patent is extended or adjusted under 35 U.S.C. 154(b) by 0 days.

(21) Appl. No.: 09/979,137

(22) PCT Filed: May 11, 2000

(86) PCT No.: PCT/DK00/00250

§ 371 (c)(1),
(2), (4) Date: Nov. 19, 2001

(87) PCT Pub. No.: WO00/69586

PCT Pub. Date: Nov. 23, 2000

(30) Foreign Application Priority Data

May 17, 1999 (WO) ..... PCT/DK99/00267

(51) Int. Cl.[7] ..... B22C 15/00
(52) U.S. Cl. ..... 164/169; 164/187; 164/207
(58) Field of Search ..... 164/169, 187, 164/207, 182, 195

(56) References Cited

U.S. PATENT DOCUMENTS 4,721,148 A * 1/1988 Knudsen ..... 164/187
5,246,058 A * 9/1993 Murata ..... 164/182

* cited by examiner

*Primary Examiner*—M. Alexandra Elve
*Assistant Examiner*—I-H Lin
(74) *Attorney, Agent, or Firm*—Larson & Taylor PLC

(57) ABSTRACT

In an apparatus for producing casting mould parts by compacting sand or other like material between a vertical squeeze plate (1) and a vertical swingable plate (2) in a squeeze chamber (3), wherein the swingable plate (2) swings away after the compaction to allow passage of the mould part from squeeze chamber (3) by further forward movement of the squeeze plate (1) and the swingable plate is journaled on a front yoke (4) mounted on guide columns (5) for movement relative to the squeeze chamber (3), a pull yoke (6) is placed behind the squeeze chamber (3) and connected to the guide columns (5). At least two of the guide columns (5) are journalled in a number of guides (7) connected to a fixed part of the apparatus close to the position of the front yoke (4) in the compacting position and the pull yoke (6) is provided with at least one guide (8) journaled on guide columns (9) connected to fixed parts of the apparatus. By this construction the rigidity of the frame structure consisting of front yoke (4), guide columns (5) and pull yoke (6) is increased by the guidance of the pull yoke which prevents movements in a plane perpendicular to the intended movement of the frame structure.

9 Claims, 3 Drawing Sheets

APPARATUS FOR PRODUCING CASTING MOULD PARTS AND COMPRISING AUXILIARY GUIDING MEANS

TECHNICAL FIELD

The present invention relates to an apparatus for producing casting mould parts by compacting sand or other like material between a vertical squeeze plate and a vertical swingable plate forming movable end walls in a squeeze chamber. The swingable plate can swing away after compaction to allow passage of the mould part from the squeeze chamber by further forward movement of the squeeze plate and the swingable plate is journalled on a front yoke which is in turn mounted on guide columns for movement relative to said squeeze chamber. A pull yoke is placed behind the squeeze chamber and connected to the guide columns. The front yoke, the pull yoke and the guide columns form a relatively rigid frame structure parallel with the longitudinal axis of the squeeze chamber. An apparatus of this kind is e.g. known from EP-231,741, and EP-020,082.

BACKGROUND ART

In such known apparatuses the pull yoke is only controlled in its movements by the guide columns and accordingly, uneven forces applied to the squeeze plate and the swingable plate, respectively, in connection with differently shaped patterns will cause a deformation of the relatively rigid frame structure consisting of the guide columns and the two connected yokes. In order to reduce such deformation and correspondingly reduce the tilting movement of the swingable plate, it is known, e.g. from EP-231,741, to provide bearings for the guide columns close to the front of the squeeze chamber and close to the back of the squeeze chamber. However, this will not completely prevent a certain tilting movement of the swingable plate during the compacting.

DISCLOSURE OF THE INVENTION

It is the object of the invention to further reduce such deformation and in accordance with the invention, this is achieved by the provision of means for guiding the pull yoke as discussed in detail hereinbelow. By means of this, the pull yoke is directly guided and supported against movements in a plane perpendicular to the intended movement of the frame structure and accordingly, a more rigid frame structure is achieved providing a more rigid guidance of the swingable plate, in particular preventing a tilting movement, without substantially increasing the dimensions of the apparatus, and without substantially increasing the weight of the moved frame structure consisting of the front yoke, the pull yoke and the guide columns.

BRIEF DESCRIPTION OF THE DRAWINGS

In the following detailed part of the present description, the invention will be explained in more detail with reference to the exemplary embodiments of an apparatus for producing casting mould parts according to the invention shown in the drawings, in which.

DESCRIPTION OF THE PREFERRED EMBODIMENTS

Figure 1:
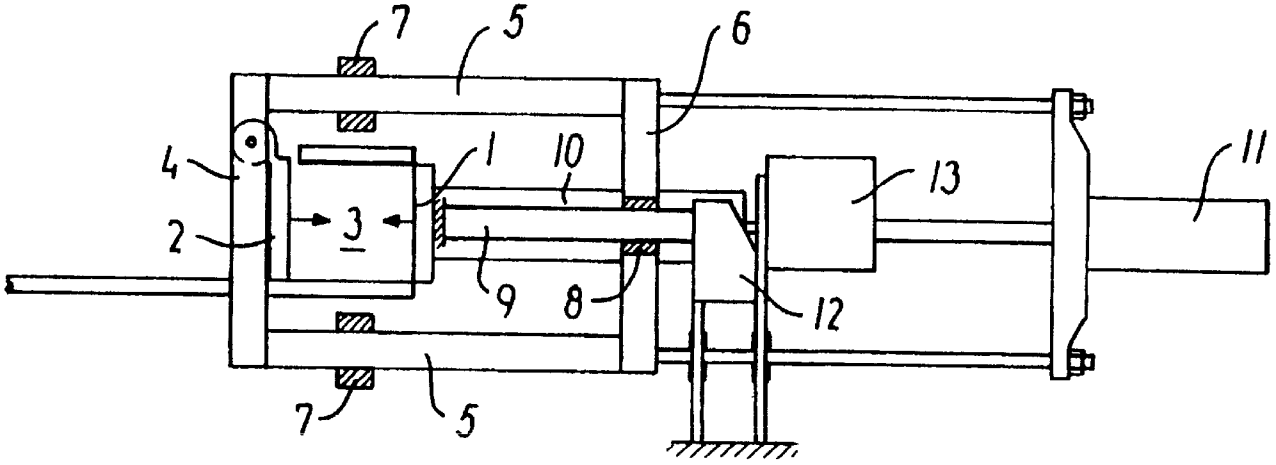
FIG. 1 shows a schematic side view of an apparatus in accordance with the invention in the compacting position.
Figure 2:
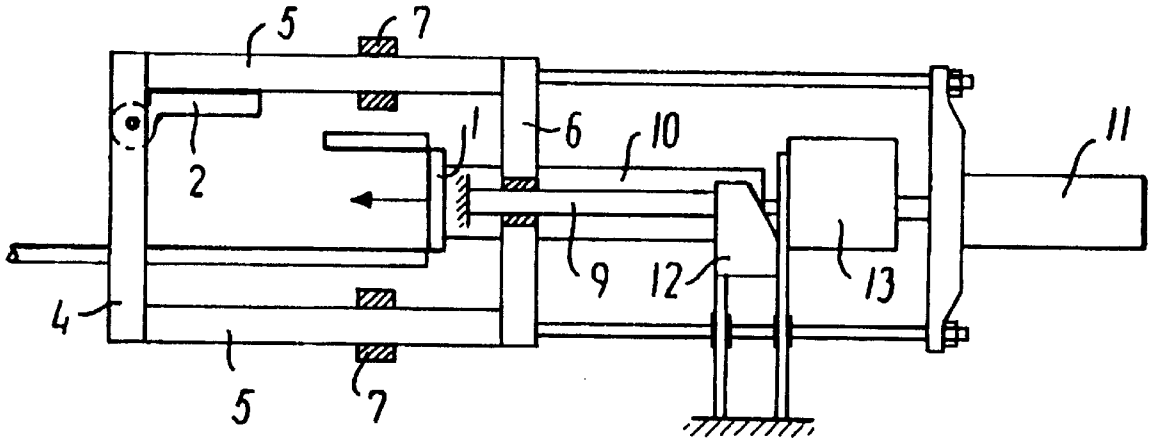
FIG. 2 shows the apparatus in FIG. 1 in the extraction position.

The apparatus for producing casting mould parts by compacting sand or other like material is of the type comprising a vertical squeeze plate 1 and a vertical swingable plate 2 forming movable end walls in a squeeze chamber 3. The swingable plate 2 is swingably connected to a front yoke 4 which is mounted on guide columns 5 for movement relative to the squeeze chamber 3. A pull yoke 6 is connected to the guide columns 5 at the ends opposite the front yoke 4. The guide columns 5 are journalled in guides 7 connected to the squeeze chamber 3 close to the position of the front yoke 4 in the compacting position shown in FIG. 1, and the pull yoke 6 is connected to a hydraulic drive unit 11 for moving the frame structure consisting of the front yoke 4, the pull yoke 6 and the guide columns 5, whereby the swingable plate 2 is moved relative to the squeeze chamber 3. In the construction shown in FIGS. 1 and 2, the pull yoke 6 comprises guides 8 journalled on auxiliary guide columns 9, whereby the movement of the pull yoke 6 is controlled. The auxiliary guide columns 9 are at one end, close to the squeeze chamber 3, connected to the squeeze chamber 3 or other fixed part of the apparatus, and at the opposite end the auxiliary guide columns 9 are fixed to a fixed part of the apparatus, in FIGS. 1 and 2 shown as a block 12. The movement of the squeeze plate 1 is provided by means of a hydraulic drive unit 10.

By the construction shown, the frame structure consisting of the front yoke 4, the guide columns 5 and the pull yoke 6 is relatively compact, increasing the rigidity of this frame structure, and the distance between the guides 7 for the guide columns 5 and the guides 8 for the auxiliary guide columns 9 is close to maximum in the compacting position shown in FIG. 1, in which the forces on the structure is at maximum, and this distance is smaller in the extraction position shown in FIG. 2, in which position the forces on the structure are minimal and the rigidity is of minor importance.

The apparatus for producing casting mould parts functions in the traditional way, the squeeze chamber 3 being filled with sand and said sand being compacted between the squeeze plate 1 and the swingable plate 2 which are moved into the chamber 3 by means of the hydraulic drive units 10 and 11 fixed to block 13. After compacting, the hydraulic drive unit 11 moves the swingable plate 2 away from the squeeze chamber 3 and the swingable plate is moved to the position shown in FIG. 2 in order to allow passage of the mould part from the squeeze chamber 3 by forward movement of the squeeze plate 1 by means of the hydraulic drive unit 10. The mould parts leaving the apparatus forms a mould string used for mould-string casting as known by a man skilled in the art.

Figure 3:
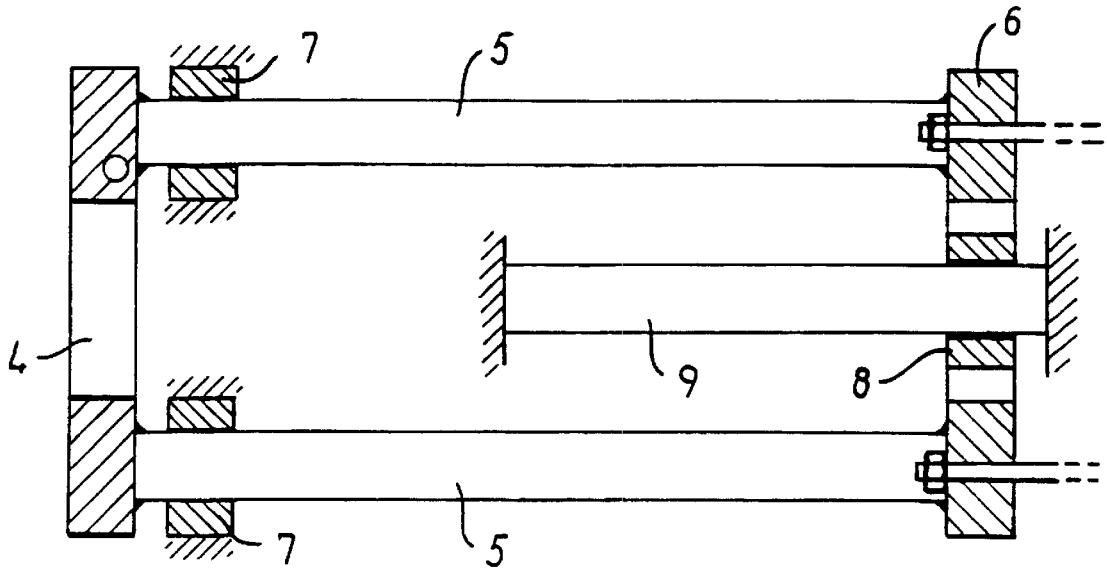
FIG. 3 is a detailed drawing of parts of the apparatus in FIG. 1.

FIG. 3 shows the essential parts of the apparatus in accordance with the invention, namely the frame structure consisting of the front yoke 4, the guide columns 5 and the pull yoke 6, the guide columns 5 being journalled in guides 7 and the pull yoke 6 comprising guides 8 journalled on auxiliary guide columns 9. In FIG. 3, the system is shown in the compacting position and it is clear from this drawing that the front yoke 4 is intimately controlled in its position by the guides 7 and the position of the pull yoke 6 in a vertical plane perpendicular to the movement direction of the pull yoke 6 is intimately controlled by the engagement between the guides 8 and the auxiliary guide columns 9, which are connected to a fixed part of the apparatus close to the position of the guides 8 in the compacting position.

Figure 4:
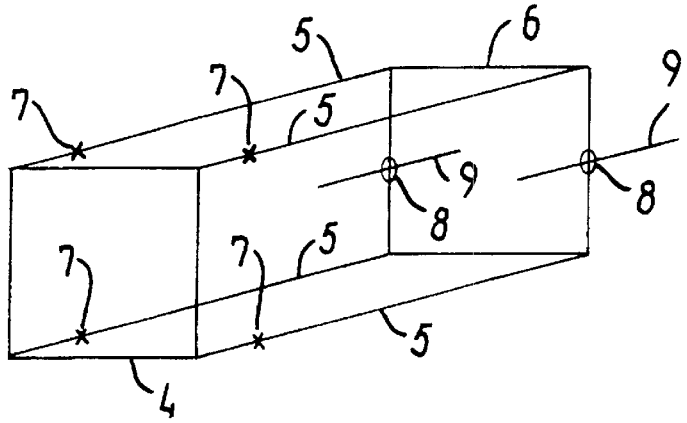
FIG. 4 is a schematic sketch indicating an embodiment of the invention corresponding to FIG. 1.
Figure 5:
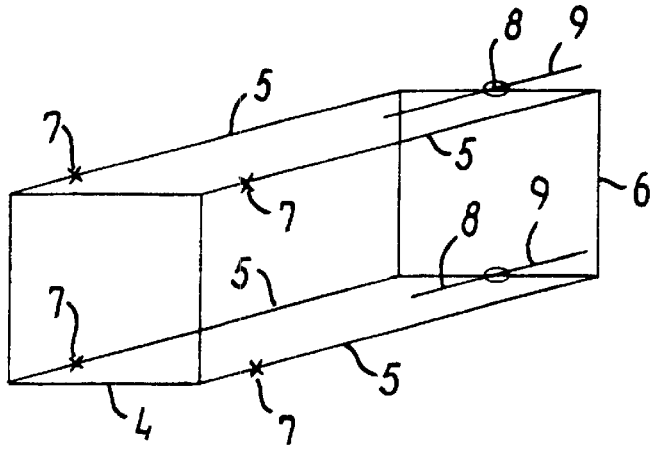
FIG. 5 is a sketch corresponding to FIG. 4, showing an alternative embodiment of the invention.

FIGS. 4 and 5 schematically show two different possible positions of the auxiliary guide columns 9 and the corresponding guides 8 in the pull yoke 6, whereas the positions of the guides 7 for the guide columns 5 are the same in the two Figures.

Figure 6:
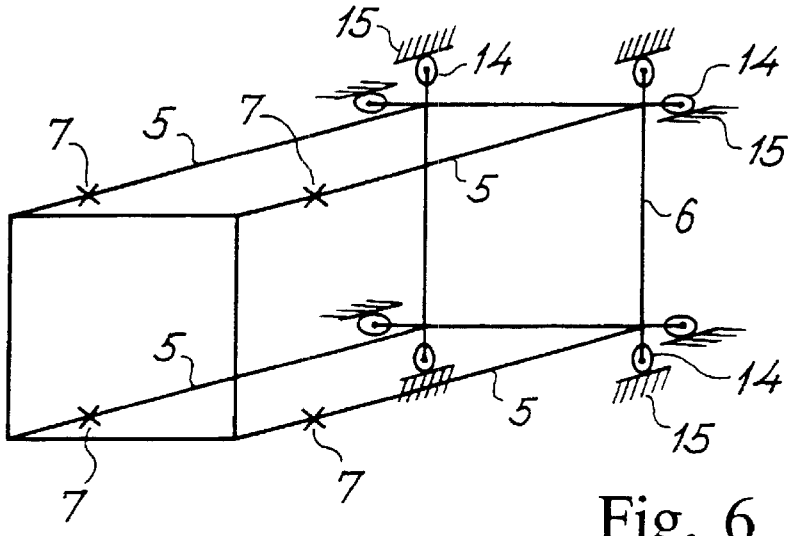
FIGS. 6, 7 and 8 show alternative constructions for guiding the pull yoke.
Figure 7:
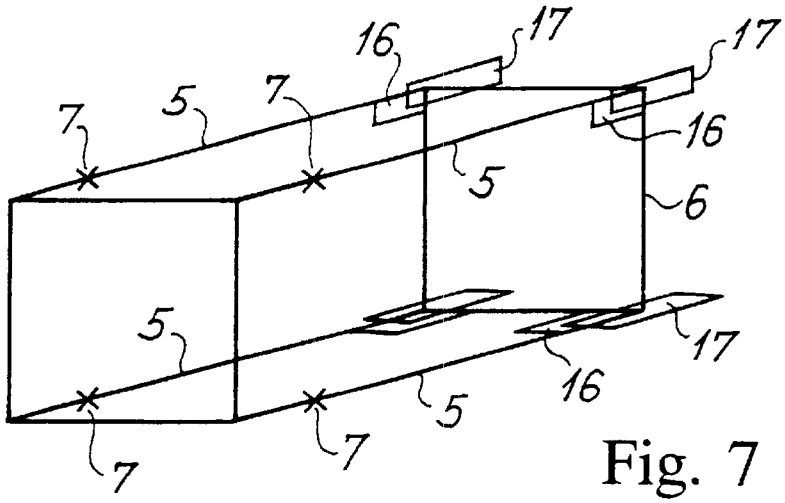
Figure 8:
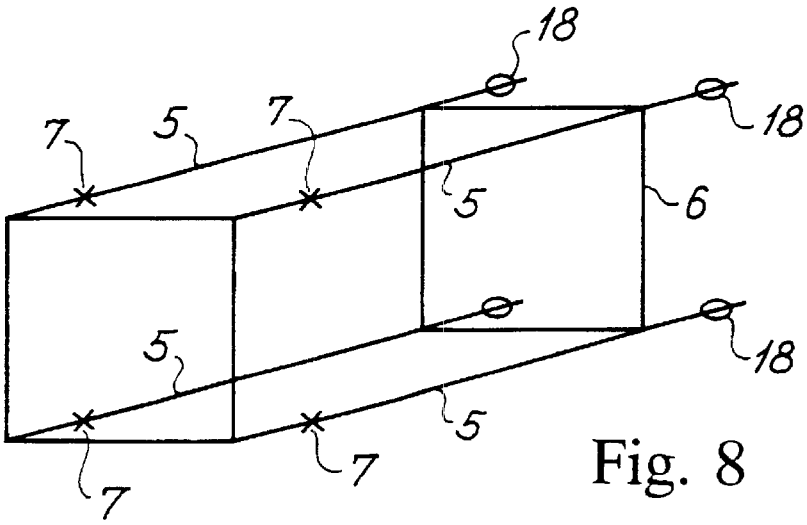

FIGS. 6, 7 and 8 show alternative constructions for providing a direct guiding of the pull yoke 6 in the compacting position.

The construction shown in FIG. 6 comprises rollers 14 connected to the pull yoke 6 and engaging corresponding rolling surfaces 15 on a fixed part of the apparatus. Naturally, the positions of the rollers 14 and rolling surfaces 15 may be reversed.

The construction shown in FIG. 7 comprises bearing surfaces 16 on the pull yoke 6, co-operating with corresponding bearing surfaces 17 on a fixed part of the apparatus. Due to the fact that the direct guiding of the pull yoke 6 is only needed in the compacting position thereof, the bearing surfaces 17 may be formed in such a way that they are only in contact with the bearing surfaces 16 on the pull yoke 6 in positions close to this compacting position, whereby a "docking" function for the pull yoke 6 is provided.

The construction shown in FIG. 8 comprises continuations of the columns 5 behind the pull yoke 6 and, at least during the compacting, these continuations of the columns 5 are engaging guides 18 connected to a fixed part of the apparatus.

It will be evident for a man skilled in the art that many other alternatives may be envisaged without departing from the following claims.

What is claimed is:

1. Apparatus for producing casting mould parts by compacting a material comprising:

a squeeze chamber having a longitudinal axis and including a vertical squeeze plate at a rear end and a vertical swingable plate at a front end;

a rigid frame structure having a longitudinal axis parallel with the longitudinal axis of said squeeze chamber and including a front yoke to which said swingable plate is pivotally mounted whereby said swingable plate swings away after compaction of the material into a mould part to allow passage of the mould part from the squeeze chamber by a forward movement of the squeeze plate, guide columns to which said front yoke is mounted, and a pull yoke located behind said squeeze chamber and connected to said guide columns;

at least two respective fixed guides in which at least two respective said guide columns are respectively journalled for movement parallel to the longitudinal axis of said squeeze chamber, whereby said guide columns, said pull yoke and said front yoke are together movable relative to said squeeze plate between a compaction configuration and an extraction configuration of said squeeze chamber, and such that said guides are located closer to said front yoke when said squeeze chamber is in the compaction configuration than when said squeeze chamber is in the extraction configuration; and a guiding means for guiding said pull yoke and hence said frame structure for movement between the compaction and the extraction configuration of said squeeze chamber, and against movements in a plane perpendicular to the longitudinal axis of said frame structure, said guiding means being closer to said pull yoke when said squeeze chamber is in the compaction configuration than when said squeeze chamber is in the extraction configuration.

2. Apparatus for producing casting mould parts as claimed in claim 1, wherein said guiding means includes:

a fixed part which is located closer to said pull yoke when said squeeze chamber is in the compaction configuration than when said squeeze chamber is in the extraction configuration;

an auxiliary guide column connected at one end to said fixed part and connected at another end to said squeeze chamber adjacent said squeeze plate; and a guide mounted to said pull yoke to which said auxiliary guide column is journalled.

3. Apparatus for producing casting mould parts as claimed in claim 2, wherein said guiding means further includes:

two respective said auxiliary guide columns; and two respective said guides, said two guides being mounted symmetrically to said pull yoke.

4. Apparatus for producing casting mould parts as claimed in claim 1, wherein said guiding means includes respective rollers provided on the pull yoke and associated fixed roller surfaces.

5. Apparatus for producing casting mould parts as claimed in claim 1, wherein said guiding means includes co-operating bearing surfaces provided on said pull yoke and respective fixed parts.

6. Apparatus for producing casting mould parts as claimed in claim 1, wherein said guiding means includes continuations of said guide columns behind said pull yoke and corresponding fixed guides cooperating with said continuations.

7. Apparatus for producing casting mould parts as claimed in claim 1:

wherein said front yoke and said pull yoke each have four corners; and wherein said frame structure includes four guide columns connecting said front and pull yokes at the corners thereof.

8. Apparatus for producing casting mould parts as claimed in claim 7, wherein said four guide columns are journalled in respective said fixed guides.

9. Apparatus for producing casting mould parts as claimed in claim 1, and further including:

a first hydraulic unit which moves said squeeze plate; and a second hydraulic unit which moves said frame structure.

* * * * *